United States Patent [19]

Levasseur

[11] Patent Number: 5,040,658

[45] Date of Patent: Aug. 20, 1991

[54] COIN DIVERTOR ASSEMBLY

[75] Inventor: Joseph L. Levasseur, Chesterfield, Mo.

[73] Assignee: Coin Acceptors, Inc., St. Louis, Mo.

[21] Appl. No.: 365,178

[22] Filed: Jun. 12, 1989

Related U.S. Application Data

[63] Continuation-in-part of Ser. No. 233,887, Aug. 16, 1988, Pat. No. 4,838,406.

[51] Int. Cl.[5] ..... G07F 1/04

[52] U.S. Cl. ..... 194/346

[58] Field of Search ..... 194/346

[56] References Cited

U.S. PATENT DOCUMENTS 1,795,287 3/1931 Bottome ..... 194/346 X 2,236,571 4/1941 Hoyt et al. ..... 194/346 X

*Primary Examiner*—F. J. Bartuska

*Attorney, Agent, or Firm*—Cohn, Powell & Hind

[57] ABSTRACT

This coin divertor assembly (12) includes a body (14), defining a coin-entry path (20) and first and second coin exit paths (24, 26). A divertor member 30 is mounted to the body and is actuated by a pulsed solenoid for movement between first and second positions to divert coins C to one or other of said coin-exit paths. A biased latch member (50) is pivotally mounted to the body. The latch member is held against rotation by engagement with the divertor member when the divertor member is in the first position and engages the divertor member to hold the divertor member against rotation to the first position when the divertor member is in the second position. The divertor member is held until the latch member is rotated from the support position and the latch member may include an arm (56) extending into a coin-exit path, which can be coin-impacted to rotate the latch member out of engagement with the divertor member to permit the divertor member to return to its first position.

7 Claims, 1 Drawing Sheet

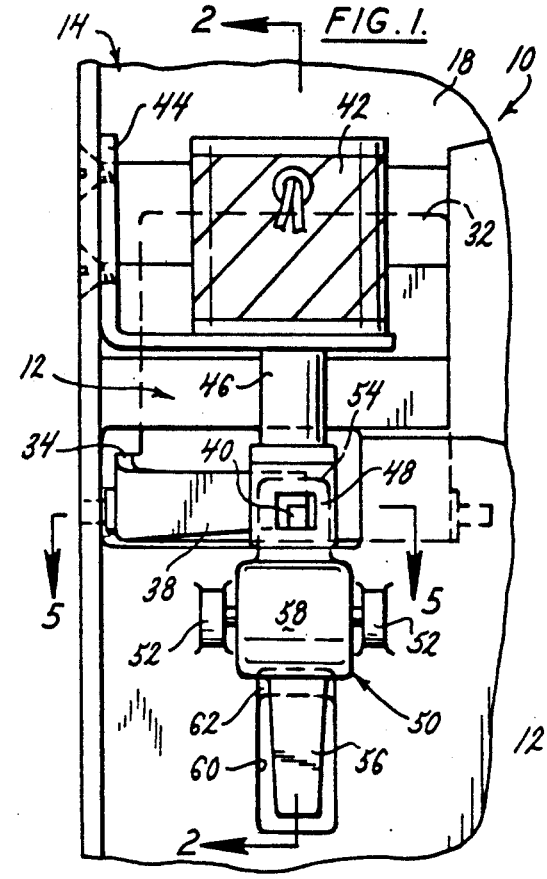
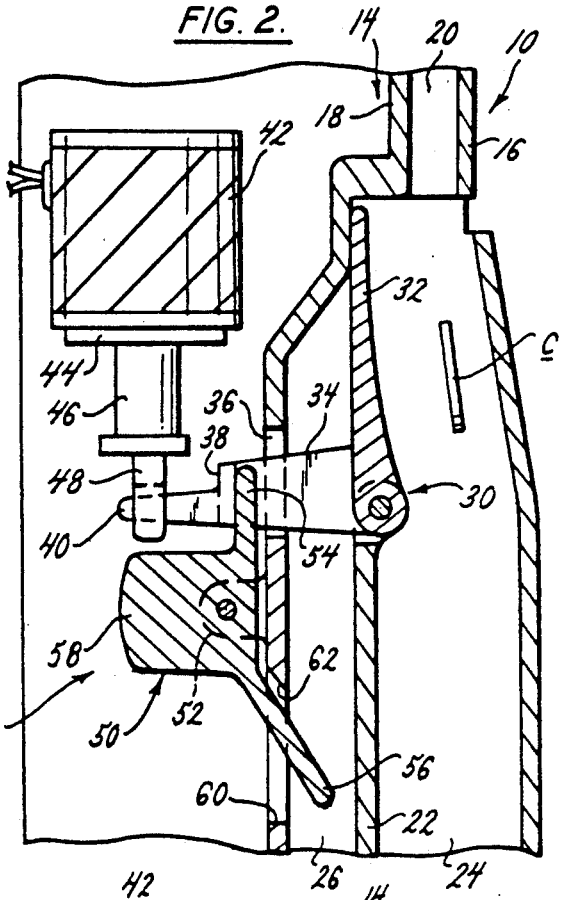
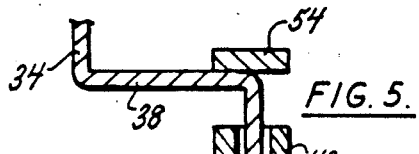
FIG. 5.
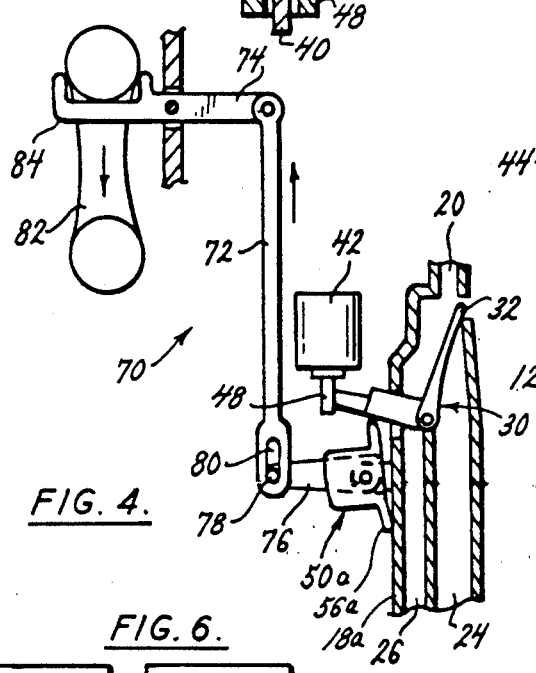
FIG. 4.
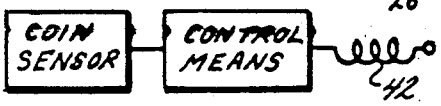
FIG. 6.
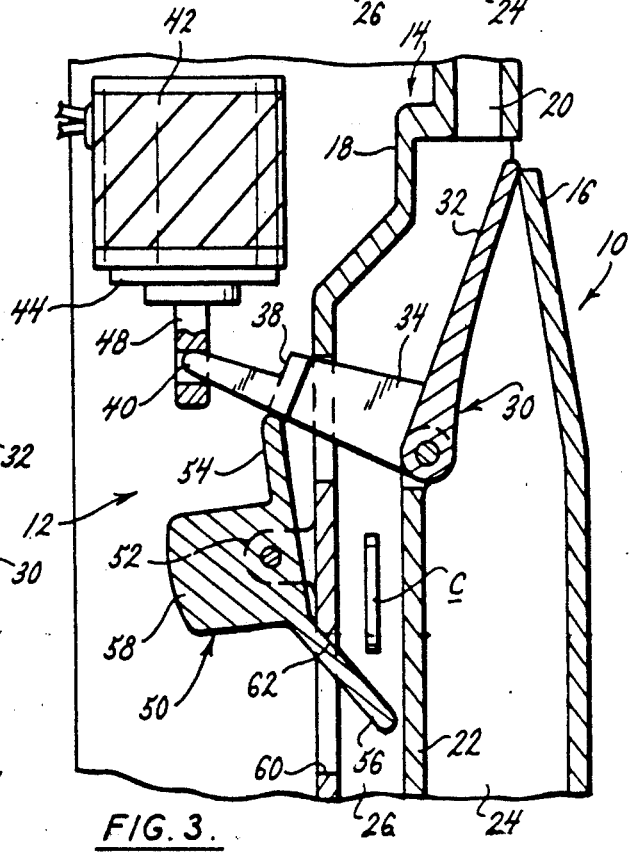
FIG. 3.

COIN DIVERTOR ASSEMBLY

This is a continuation-in-part of copending application Ser. No. 07/233,887 filed Aug. 16, 1988, now U.S. Pat. No. 4,838,406.

BACKGROUND OF THE INVENTION:

This invention relates generally to a coin divertor assembly and more particularly to an assembly which requires low power for operation.

Coin diverting assemblies are commonly used in coin accepting systems for directing a coin into alternative paths, for example, into an acceptance path or a rejection path. In general, such devices commonly include a movable gate providing a divertor member which is moved between two positions and held in one or other of the positions for a specified period during passage of the coin. With such divertors it is necessary to apply power to hold the divertor member in the chosen position for the full duration required for the passage of the coin, usually by means of a solenoid. While this presents no problem in those instances in which the necessary power is available it presents a considerable problem when the only available power is insufficient to provide the holding force for the full duration required. Copending and co-owned U.S. patent application Ser. No. 07/233,887 discloses a coin divertor assembly having a bi-stable divertor member which is movable between two stable equilibrium positions to direct coins into alternative paths. As disclosed a pulse of electrical energy is required to move the coin from each position of stable equilibrium to the other position. Thus, electrical power is required to accomplish both movements.

This divertor assembly overcomes these and other problems in a manner not disclosed in the known prior art.

SUMMARY OF THE INVENTION

This coin divertor assembly provides a divertor member which is movable between two positions to direct coins into alternative paths and is operable with the application of relatively low power, for a short time duration and sufficient only for movement in one direction.

The assembly utilizes a divertor member which is actuated by a pulse of electrical energy which moves the divertor from a first position to a second position, the divertor being held in the second position by a biased latch, the divertor being returned to the first position by release of the latch by non-electrical means and holding the latch against movement until the application of another electrical pulse.

This coin divertor assembly includes a body defining a coin-entry path and first and second coin exit paths; a divertor member pivotally mounted to the body and movable between a first position diverting coins from the coin-entry path to the first coin exit path and a second position diverting coins from the coin-entry path to the second coin-exit path; actuating means providing a short duration impulse force for moving the divertor member from the first position to the second position, and latch means pivotally mounted to the body and including biasing means tending to rotate the latch means in one direction, said latch means being held against rotation by said divertor member when said divertor member is in said first position, and said divertor member being held against rotation by said latch means when said divertor member is in said second position, said latch means including a force receiving portion rotate said latch means out of engagement with said divertor member when said divertor member is in said second position to permit said divertor member to return to said first position.

It is an aspect of this invention to provide that said latch means force-engageable portion is impactable by a coin to rotate said latch means out of engagement with said divertor member.

It is another aspect of this invention to provide that the divertor member includes an outwardly extending engagement portion, and the latch means includes a first engagement portion engaged by said divertor member engagement portion to hold said latch means against rotation when said divertor member is in said first position and engaging said divertor member engagement portion to hold said divertor member against rotation when said divertor member is in said second position, and a second engagement portion extending into said second exit path when said divertor member is in said second position said second portion being coin-impactable to rotate said first engagement portion.

It is still another aspect of this invention to provide that said latch biasing means is an offset weight tending to rotate said latch second engagement portion into said second exit path.

Another aspect of this invention is to provide that said divertor member has a bell crank configuration including an outwardly extending arm providing a first engagement portion, and said latch means includes an extending arm providing said first engagement portion, and an oppositely extending arm providing said second engagement portion.

Still another aspect of this invention is to provide that said actuating means is a solenoid connected to said divertor member outwardly extending arm to rotate said divertor member from said first position into said second position.

Yet another aspect of this invention is to provide that said latch means includes an offset weight disposed between the arms of said latch means, and the body includes stop means limiting rotation of said latch means into the second exit path and conditioning said latch means for engagement by said divertor member when said divertor member is in said second position.

It is an aspect of this invention to provide that said divertor member outwardly extending arm includes a hook portion engageable by said associated latch arm.

It is another aspect of this invention to provide latch actuating means for rotating said latch means out of engagement with said divertor member independent of impaction by a coin.

It is still another aspect of this invention to provide that the latch means force engageable portion includes an arm, and said latch actuating means includes a linkage assembly connected to said arm.

It is still another aspect of this invention to provide a divertor assembly which utilizes mechanical and electrical components which are both simple and inexpensive.

BRIEF DESCRIPTION OF THE DRAWING

FIG. 1 is an elevational view of the assembly;

FIG. 2 is a cross sectional view taken on line 2—2 of FIG. 1 showing the divertor member in a first position;

FIG. 3 is a similar view to FIG. 2 showing the divertor member in a second position;

FIG. 4 is a view, reduced in size, showing an independent latch actuating linkage;

FIG. 5 is a partial cross section taken on line 5—5 of FIG. 1; and

FIG. 6 is a block diagram of the control means.

DESCRIPTION OF THE PREFERRED EMBODIMENT

Referring now by reference numerals to the drawing and first to FIGS. 1 and 2 it will be understood that the coin assembly forms part of a coin device 10 and is indicated generally by numeral 12. The assembly 12 includes a body 14 having walls 16 and 18 defining a coin-entry path 20 and an intermediate wall 22 cooperating with the lower portions of said walls 16 and 18 to define first and second coin exit paths 24 and 26 which may respectively define a return path and an accept path.

A divertor member 30, having the form of a bell crank in the preferred embodiment, is pivotally mounted to the body at the upper portion of the intermediate wall 22 to form a hinged extension of said wall 22 which is movable between a first position, shown in FIG. 2, in which it diverts coins from the coin-entry path 20 to the coin return path 24 and a second position, shown in FIG. 3, in which it diverts coins from the coin-entry path 20 to the coin-accept path 26. A similar arrangement is disclosed in copending, co-owned U.S. patent application Ser. No. 07/233,087, which is incorporated herein by reference.

The divertor member 30 includes a gate portion 32 and an outwardly extending arm 34 attached to the gate portion at one side out of the coin path 26 as shown in FIG. 5. The arm 34 extends through an opening 36 in the wall 18 and includes a perpendicular cranked portion 40 which is generally parallel to the gate portion 32 and a remote end finger portion 40. The divertor member 30 is actuated by a solenoid 42 supported by a bracket 44 fixedly attached to the body 14. The solenoid includes a spring-loaded plunger 46 having an apertured log 48 which receives the divertor finger portion 40. The divertor member 30 is moved from the first position shown in FIG. 2 to the second position shown in FIG. 3 by retraction of the spring-loaded solenoid plunger 46. The solenoid plunger 46 is retracted by a momentary impulse of electrical power which causes the divertor gate portion 32 to swing clockwise from the position shown in FIG. 2, in which the coin accept path 26 is blocked and the coin return path 24 is open, into the position shown in FIG. 3 in which the coin return path 24 is blocked and the coin accept path 26 is opened.

The divertor member 30 is held in the second position by a weighted latch member 50 as clearly shown in FIG. 3 even though power is removed from the solenoid. The latch member 50 is pivotally mounted to the body 14 by means of a pair of brackets 52 and includes an upwardly extending arm 54, constituting a first engagement portion, a downwardly extending arm 56, constituting a second engagement portion, and an offset block 58 disposed intermediate the arms 54 and 56 and constituting a latch biasing means tending to rotate the latch means 50 in a counterclockwise direction. The latch downwardly extending arm 56 extends through an opening 60 provided in the wall 18 and the upper margin 62 of said opening provides a stop means engageable with said arm to limit counterclockwise movement of said latch member 50.

The latch upwardly extending arm 54 is engaged by the divertor member perpendicular portion 38, which provides a hook-like member, and is thereby held against rotation in a counterclockwise direction, when the divertor member 30 is in the first position shown in FIG. 2. Arm 54 engages the divertor member portion 38 against rotation in a counterclockwise direction when said divertor member is in the second position shown in FIG. 3.

The second position of the divertor member 30 is maintained by said latch member 50 until said latch member is rotated in a clockwise direction to move out of a support holding position. Such movement may be induced by the impact of a coin C on the latch arm 56. When the latch arm 54 moves out of engagement with the divertor portion 40, the spring-loaded solenoid plunger 46 returns to its extended position carrying the divertor arm 32 with it so that the divertor member 30 returns to its first position and the latch members 30 is once again held against counterclockwise rotation by said divertor perpendicular portion 38.

In the embodiment shown the divertor member 30 is intended to be moved into its second position before the arrival of a coin C. An electrical impulse supplied to the solenoid 42 can be triggered as by an upstream sensing device which responds to the sensing of the coin in a manner well-known to those skilled in the art. For example, as shown in FIG. 6, a control means responds to a coin sensor to initiate an impulse supplied to the solenoid 42 to move the divertor member 30 from its original position to its second position. Only a momentary pulse to the solenoid is necessary to move the divertor member 30 into its second position in which it is held by the latch member 50 until the coin C has successfully passed into the accept path. Once this happens and the coin C impacts the latch arm 56, causing the latch to rotate out of engagement with the divertor member 30, the divertor member returns to its first position closing the accept path and opening the return path. It will be readily understood that this sequence of events is achieved by the application of only a momentary pulse of electrical energy to the solenoid 42 because the plunger is operatively held in the retracted position by the latch member 50 until the latch member 50 is rotated by coin impact energy out of its support condition permitting the divertor member to return to its initial position.

There may be occasions when it is desired to re-set the divertor member 30 independently, that is to say by means other than the impact of a coin C. FIG. 4 shows such an arrangement in which a modified latch member 50*a* is re-set by means of a linkage assembly 70 which includes pivitally connected link members 72 and 74. Except as indicated the modified assembly is identical to that previously described. As shown in FIG. 4 the latch member 50*a* includes a rearwardly extending arm 76 having a pin 78 which is engageable within a slot 80 provided in link member 72. In the support condition, the shortened lower arm 56*a* engages the wall 18*a* which provides a stop means limiting counterclockwise movement of said latch member 50. The modified latch member 50*a* is moved from the support position shown in FIG. 4 by upward movement of the link member 72 induced by downward movement of the end of link member 74. When the system is used for a coin operated telephone, the downward force may be provided, for example, by returning a handset 82 to the cradle 84 provided at the end of the link 74.

Although the improved coin divertor assembly has been described by making particularized reference to preferred embodiments, the details of description are not to be understood as restrictive, numerous variants being possible within the principles disclosed and within the fair scope of the claims hereunto appended.

I claim as my invention:

1. A coin divertor assembly, comprising:

(a) a body defining a coin-entry path and first and second coin-exit paths, (b) a divertor member pivotally mounted to the body and movable between a first position diverting coins from the coin-entry path to the first coin-exit path and a second position diverting coins from the coin-entry path to the second coin-exit path;

(c) actuating means providing a short duration impulse force for moving the divertor member from the first position to the second position, and (d) latch means pivotally mounted to the body and including biasing means tending to rotate the latch means in one direction, said latch means being held against rotation by said divertor member when said divertor member is in said first position, and said divertor member being held against rotation by resting on said latch means when said divertor member is in said second position, said latch means including a force-receiving portion operating independently of electrical means for rotating said latch means out of engagement with said divertor member when said divertor member is in said second position, when said force-receiving portion receives a coin, to permit said divertor member to return to said first position.

2. An assembly as defined in claim 1, in which:

(e) the divertor member includes a divertor gate portion and an outwardly extending engagement portion operatively attached to said divertor gate portion, and (f) the latch means includes:

1. a first engagement portion engaged by said divertor member engagement portion to hold said latch means against rotation when said divertor member is in said first position and engaging said divertor member engagement portion to hold said divertor member gate portion against rotation when said divertor member is in said second position, and 2. a second engagement portion extending into said second exit path when said divertor member is in said second position said second portion being coin-impactable to rotate said first engagement portion and permit rotation of said divertor member gate portion.

3. An assembly as defined in claim 2, in which:

(g) said latch biasing means is an offset weight tending to rotate said latch second engagement portion into said second exit path.

4. A coin divertor assembly, comprising:

(a) a body defining a coin-entry path and first and second coin-exit paths;

(b) a divertor member pivotally mounted to the body and movable between a first position diverting coins from the coin-entry path to the first coin-exit path and a second position diverting coins from the coin-entry path to the second coin-exit path, (c) actuating means providing a short duration impulse force for moving the divertor member from the first position to the second position, and (d) latch means pivotally mounted to the body and including biasing means tending to rotate the latch means in one direction, said latch means being held against rotation by said divertor member when said divertor member is in said first position, and said divertor member being held against rotation by said latch means when said divertor member is in said second position, said latch means including a force-receiving portion rotating said latch means out of engagement with said divertor member when said divertor member is in said second position to permit said divertor member to return to said first position, (e) said divertor member having a bell crank configuration including an outwardly extending arm providing a first engagement portion, and (f) said latch means including:

1. an extending arm engaged by said divertor member arm to hold said latch means against rotation when said divertor member is in said first position and engaging said divertor member arm to hold said divertor member in said second position, and 2. an oppositely extending arm extending into said second exit path when said divertor member is in said second position said oppositely extending arm being coin-impactable to rotate said other extending arm.

5. An assembly as defined in claim 4, in which:

(g) said actuating means is a solenoid connected to said divertor member outwardly extending arm to rotate said divertor member from said first position into said second position.

6. An assembly as defined in claim 4, in which:

(g) said latch means includes an offset weight disposed between the arms of said latch means, and p1

(h) the body includes stop means limiting rotation of said latch means into the second exit path and conditioning said latch means for engagement by said divertor member when said divertor member is in said second position.

7. An assembly as defined in claim 6, in which:

(i) said divertor member outwardly extending arm includes a hook portion engageable by said associated latch arm.

* * * * *

UNITED STATES PATENT AND TRADEMARK OFFICE

CERTIFICATE OF CORRECTION

PATENT NO. : 5,040,658

DATED : August 20, 1991

INVENTOR(S) : Joseph L. Levasseur

It is certified that error appears in the above-identified patent and that said Letters Patent is hereby corrected as shown below:

Column 2, line 3, insert --to-- before "rotate".

Column 3, line 41, delete "log" and insert --lug--.

Column 4, line 53, delete "pivitally" and insert --pivotally--.

Column 5, line 15, delete ";" and insert --,--.

Column 6, line 3, delete ";" and insert --,--.

Column 6, line 47, delete "pl".

Column 6, line 48, delete "  " before "(h)".

Signed and Sealed this

Twenty-fifth Day of October, 1994

*Attest:*

*Attesting Officer*

BRUCE LEHMAN

*Commissioner of Patents and Trademarks*